US005371576A

United States Patent [19]

Gonda

[11] Patent Number: 5,371,576

[45] Date of Patent: Dec. 6, 1994

[54] DRUM DRIVING APPARATUS

[75] Inventor: Takashi Gonda, Aichi, Japan

[73] Assignee: Minolta Camera Kabushiki Kaisha, Osaka, Japan

[21] Appl. No.: 131,896

[22] Filed: Oct. 5, 1993

[30] Foreign Application Priority Data

Oct. 16, 1992 [JP] Japan ..... 4-278263

[51] Int. Cl.[5] ..... G03G 5/00; G03G 15/00

[52] U.S. Cl. ..... 355/211; 74/572; 355/200; 355/210

[58] Field of Search ..... 355/200, 210, 211; 74/572; 492/47

[56] References Cited

U.S. PATENT DOCUMENTS

| | | | |
|---|---|---|---|
| 4,823,160 | 4/1989 | Ikuta et al. | 355/211 |
| 4,935,778 | 6/1990 | Mochida | 355/211 |
| 5,023,660 | 6/1991 | Ebata et al. | 355/200 |

FOREIGN PATENT DOCUMENTS

| | | | |
|---|---|---|---|
| 2-154278 | 6/1990 | Japan | 355/211 |
| 2-173780 | 7/1990 | Japan . | |
| 4-11267 | 1/1992 | Japan | 355/211 |
| 4-127166 | 4/1992 | Japan | 355/211 |
| 4-264457 | 9/1992 | Japan | 355/211 |
| 4-360158 | 12/1992 | Japan | 355/211 |

*Primary Examiner*—A. T. Grimley
*Assistant Examiner*—William J. Royer
*Attorney, Agent, or Firm*—Willian Brinks Hofer Gilson & Lione

[57] ABSTRACT

An apparatus has a hollow drum detachably provided on the apparatus and a drive device fixedly provided on the apparatus for drivingly rotating the drum. The drive device includes a flywheel for giving an increased moment of inertia to the drum. The drum includes a flange having an open end. A part of the flywheel is inserted into the open end of the flange when the drum is attached to the apparatus. The drum is separated from the flywheel, so that the drum as removed is lightweight and easy to handle. The drum may include a photosensitive surface and constitute a part of a process unit.

11 Claims, 10 Drawing Sheets

DRUM DRIVING APPARATUS

BACKGROUND OF THE INVENTION

1. Field of the Invention

The present invention relates to apparatus for drivingly rotating a drum, for example, to an apparatus for driving a photosensitive drum for use in electrophotographic copying machines.

2. Description of the Related Art

Apparatus for drivingly rotating a hollow drum are generally provided with a flywheel for increasing the moment of inertia to obtain stabilized rotation. The publication of Japanese Laid-Open Patent Application No. 173780/1990, for example, discloses such an apparatus wherein a flywheel is provided inside a hollow drum.

On the other hand, in the case of drums which need replacement like the photosensitive drums of electrophotographic copying machines, the drum is removably coupled to the drum driving apparatus. However, the flywheel, if installed inside the drum, makes the drum extremely heavy, so that the drum is inconvenient to handle and can not be replaced efficiently.

SUMMARY OF THE INVENTION

Accordingly, the main object of the present invention is to provide a drum driving apparatus which permits efficient replacement of the drum.

Another object of the invention is to provide a drum driving apparatus which is equipped with a flywheel for rotating the drum with good stability.

Another object of the invention is to provide an apparatus for driving a drum with the backlash of the drum suppressed.

Still another object of the invention is to provide a drum driving apparatus which permits replacement of the drum without defacement.

BRIEF DESCRIPTION OF THE DRAWINGS

These and other objects or features of the present invention will become apparent from the following description of preferred embodiments thereof taken in conjunction with the accompanying drawings, in which.

In the following description, like parts are designated by like reference numbers throughout the several drawings.

DESCRIPTION OF THE PREFERRED EMBODIMENTS

Embodiments of the present invention will be described below with reference to the drawings.

Figure 1:
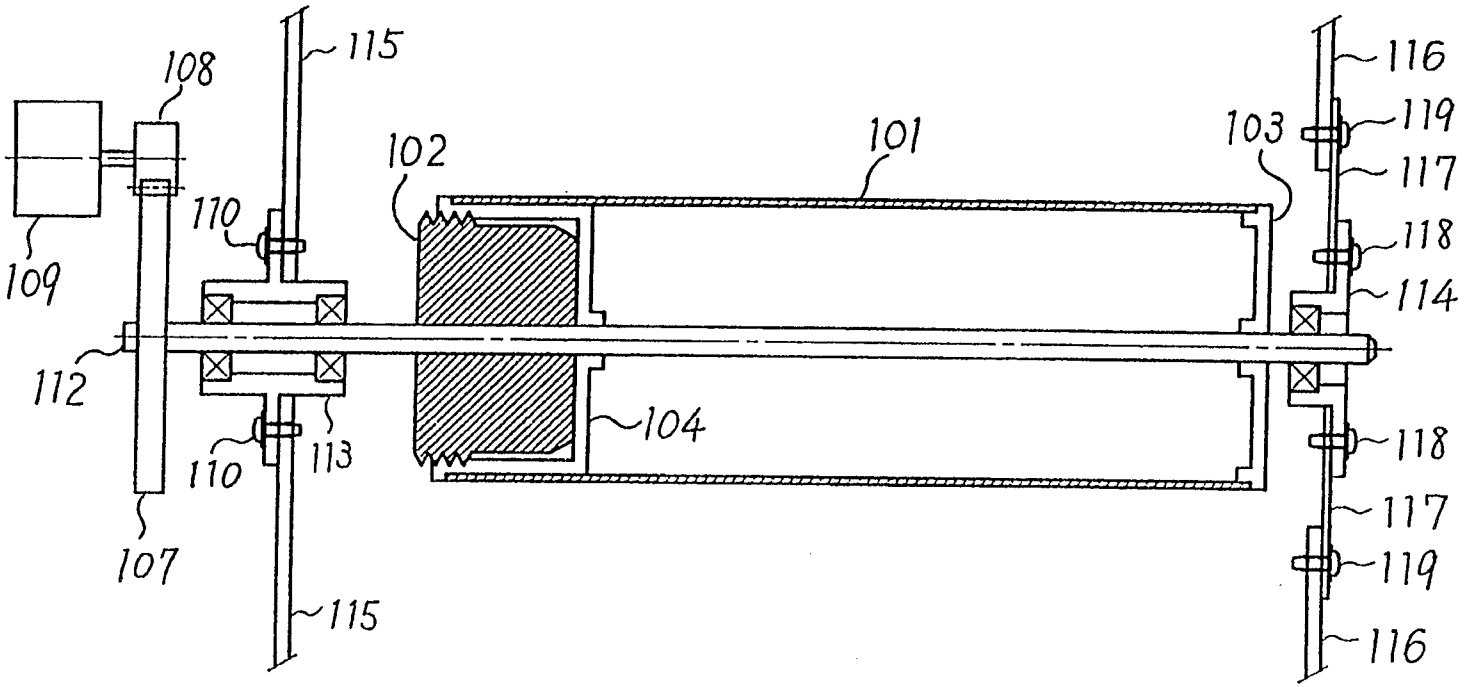
FIG. 1 is a diagram showing the construction of a drum driving apparatus as a first embodiment of the invention.
Figure 2:
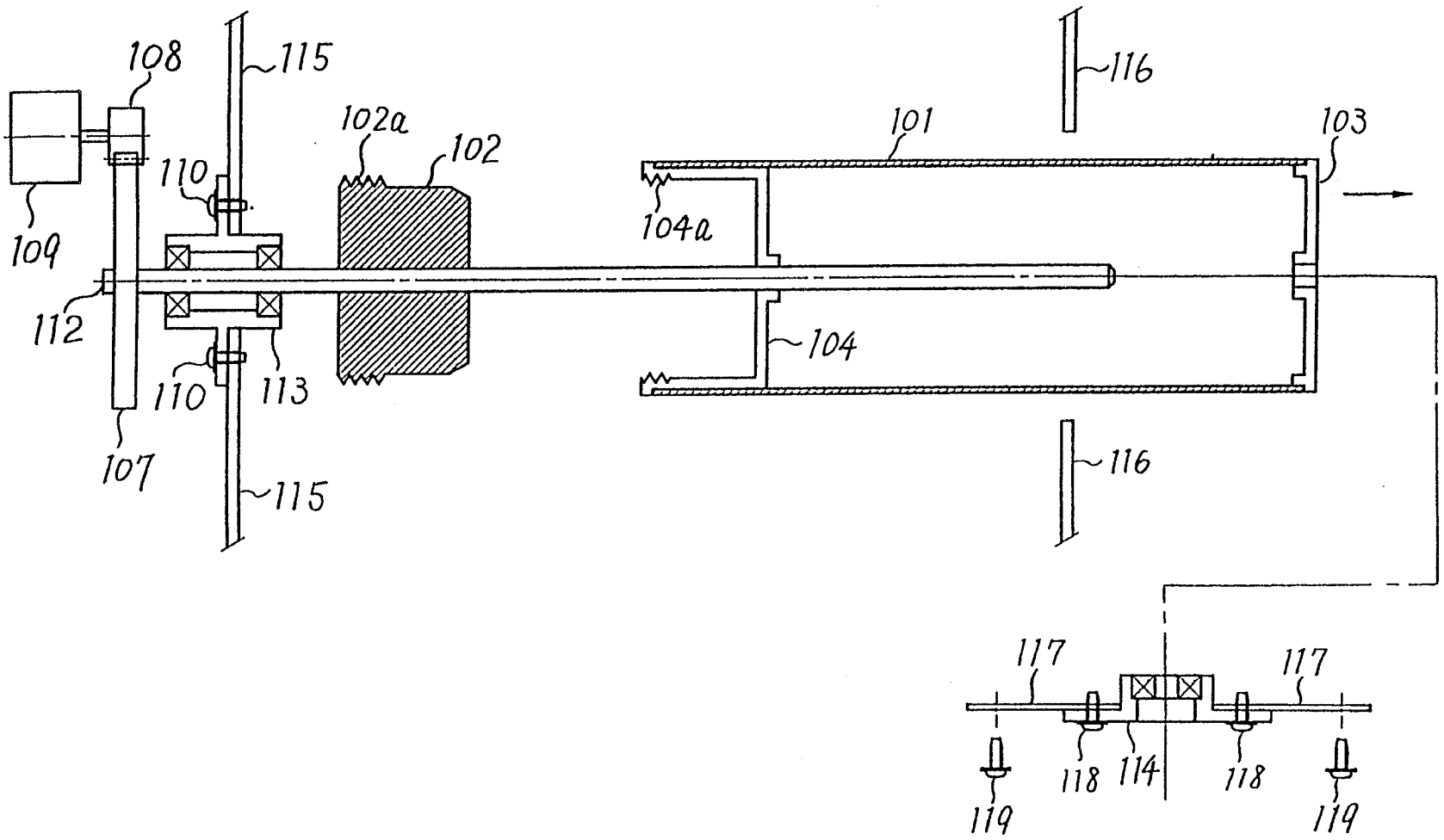
FIG. 2 is a diagram for illustrating a drum as removed from the first embodiment.

FIGS. 1 and 2 are diagrams showing the construction of a drum driving apparatus as a first embodiment of the invention.

The present embodiment is designed for a photosensitive drum for use in electrophotographic copying machines.

The photosensitive drum, which is hollow and indicated at 101, has flanges 103 and 104 at its respective longitudinal ends. The flange 104 is in the form of a cylinder having an open end and is fitted inside the drum 101. The flange 104 is formed on its inner periphery with an internally threaded portion 104*a* for screw-thread engagement with an externally threaded portion 102*a* of the flywheel 102 to be described below.

The flywheel 102 is mounted on a drive shaft 112. The flywheel 102 is shaped to fit into the flange 104 and has the externally threaded portion 102*a* screwed in the internally threaded portion 104*a* of the flange 104. The direction in which the externally threaded portion 102*a* of the flywheel 102 and the internally threaded portion 104*a* of the flange 104 are tightened up matches the direction of rotation of the drum 101. The drive shaft 112 is inserted through the flanges 104 and 103 centrally thereof to extend through the photosensitive drum 101. The drive shaft 112 has one end supported by a bearing block 113 on a main frame 115 and coupled to a motor 109 by means of gears 107 and 108. The bearing block 113 is fastened to the main frame 115 with two screws 110. The other end of the drive shaft 112 is mounted on a bearing block 114, which is attached to a mount plate 117 with two screws 118. The mount plate 117 is further fastened to a main frame 116 with two screws 119. The two screws 119 are removed when the drum 101 is to be replaced.

The drum 101 is attached to the drive shaft 112 by engaging the internally threaded portion 104*a* of the flange 104 with the externally threaded portion 102*a* of the flywheel 102. After the drum 101 has been attached to the drive shaft 112, the bearing block 114 is fitted around the drive shaft 112, and the mount plate 117 is fastened to the main frame 116 with the two screws 119. The flywheel 102 gives an increased moment of inertia to thereby diminish unevenness of rotation of the drum 101.

The photosensitive drum 101 is replaced by a new one when deteriorating owing to long use. For the replacement of the drum 101, the two screws 119 are removed to remove the bearing block 114 and the mount plate 117 from the drive shaft 112. The drum 101 is thereafter rotated in a direction to unscrew the externally threaded portion 102*a* from the internally threaded portion 104*a*, and withdrawn along the drive shaft 112. At this time, the drum 101 is separated from the flywheel 102, so that the drum 101 as removed is lightweight and easy to handle.

Figure 3:
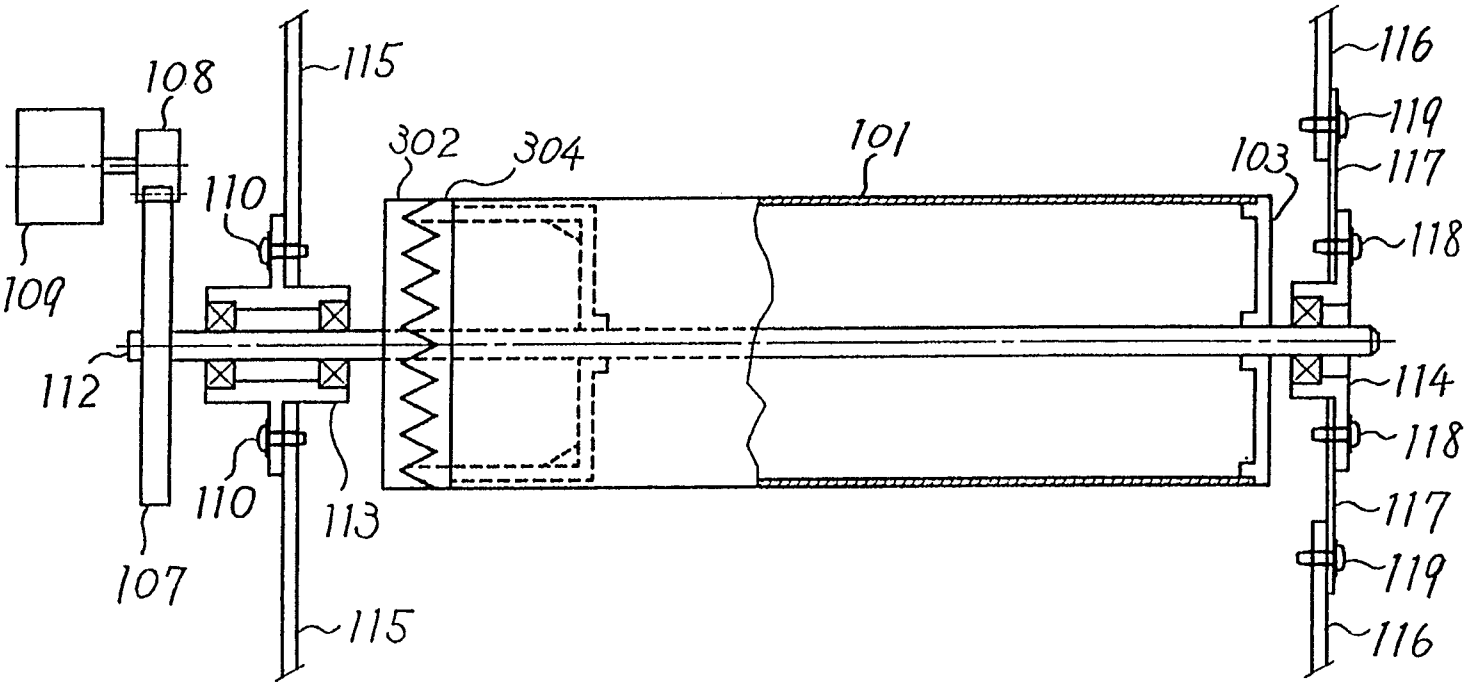
FIG. 3 is a diagram showing the construction of a drum driving apparatus as a second embodiment.
Figure 4:
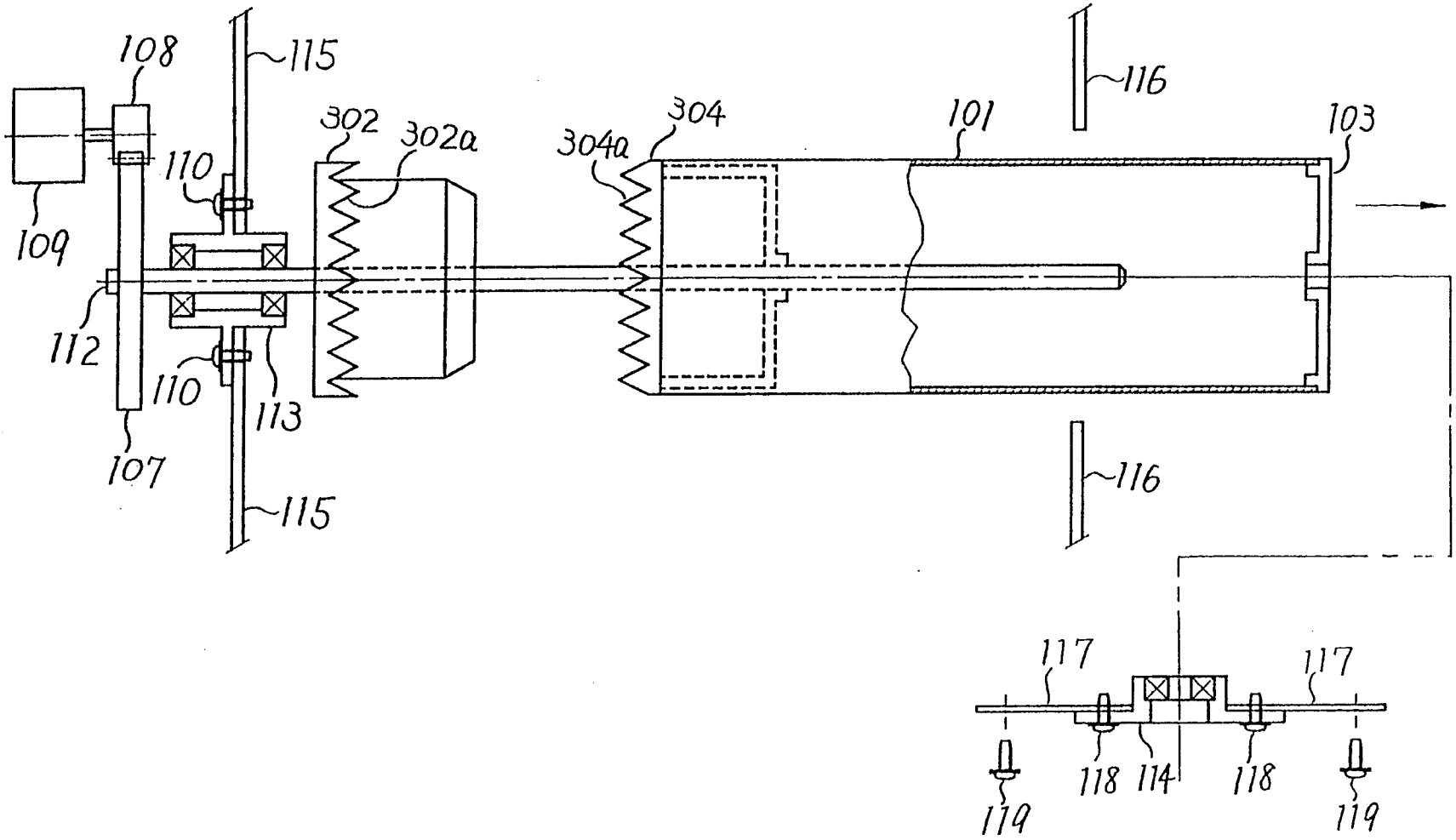
FIG. 4 is a diagram for illustrating a drum as removed from the second embodiment.

Next, FIGS. 3 and 4 show the construction of a drum driving apparatus as a second embodiment.

A photosensitive drum 101 has flanges 103 and 304 at its respective longitudinal ends. The flange 304 is in the form of a cylinder having an open end and is fitted inside the drum 101. Along the circumference of the drum 101, the open end of the flange 304 has a sawtoothed joint portion 304*a* meshable with a joint portion 302*a* of the flywheel 302 to be described below.

The flywheel 302 is mounted on a drive shaft 112. The flywheel 302 has a portion fittable into the flange 304, and the joint portion 302*a* which is sawtoothed and to be joined to the joint portion 304*a* of the flange 304.

The photosensitive drum 101 is mounted on the drive shaft 112 with the joint portion 304*a* of the flange 304 in mesh with the joint portion 302*a* of the flywheel 302. The flywheel 302 gives an increased moment of inertia to thereby diminish unevenness of rotation of the drum 101.

When the drum 101 to be driven by the second embodiment is to be replaced, two screws 119 are removed, and a bearing block 114 is removed from the drive shaft 112. The drum 101 is then removed from the drive shaft 112 merely by withdrawing the drum 101 in the direction of arrow shown in FIG. 4. This separates the drum 101 from the flywheel 302. Since the photosensitive drum 101 is thus separated from the flywheel 302, the drum 101 as removed is lightweight and easy to handle. Further according to the second embodiment, the joint portions 302*a* and 304*a* are sawtoothed and therefore diminish circumferential backlash of the drum 101.

Figure 5:
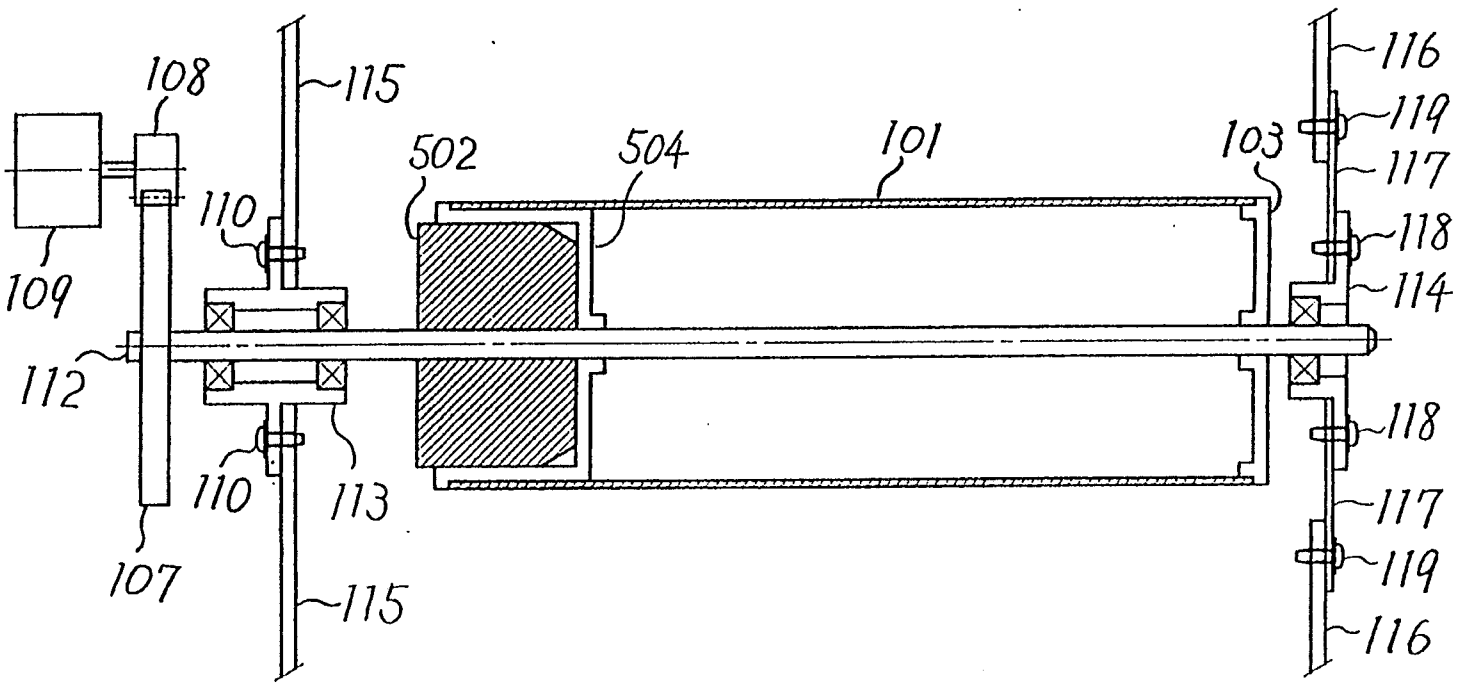
FIG. 5 is a diagram showing the construction of a drum driving apparatus as a third embodiment.
Figure 6:
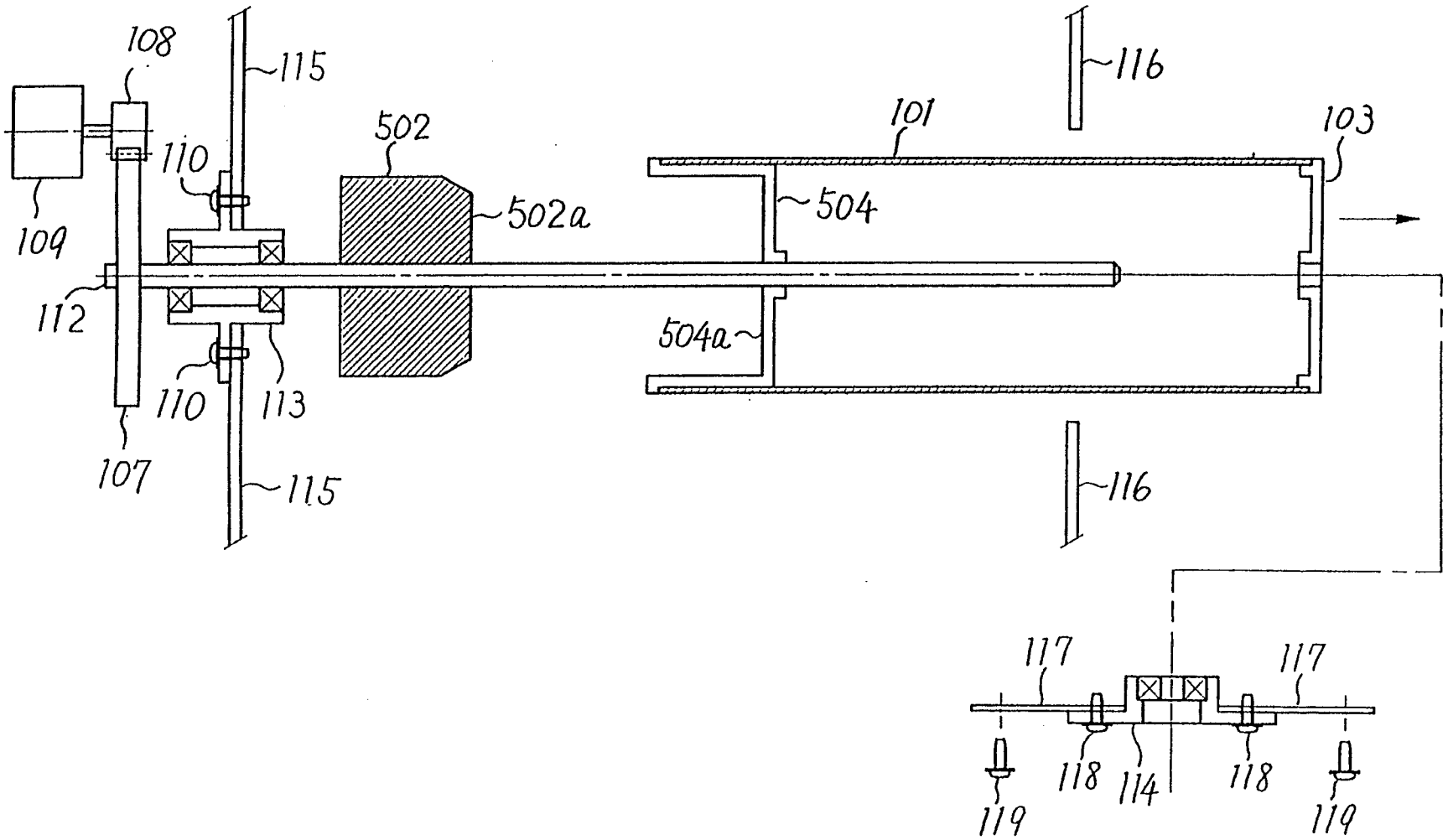
FIG. 6 is a diagram for illustrating a drum as removed from the third embodiment.

Next, FIGS. 5 and 6 show the construction of a drum driving apparatus as a third embodiment.

A photosensitive drum 101 has flanges 103 and 504 at the respective longitudinal ends thereof. The flange 504 is in the form of a cylinder having an open end and is fitted inside the drum 101. The flange 504 has a magnetized face 504*a* for causing a magnetized face 502*a* of the flywheel 502 to be described below to join thereto.

The flywheel 502 is mounted on a drive shaft 112. The flywheel 502 is so shaped as to fit into the flange 504 and has the magnetized face 502*a* adapted to join to the magnetized face 504*a* of the flange 504.

The photosensitive drum 101 is mounted on the drive shaft 112 with the magnetized face 504*a* of the flange 504 in intimate contact with the magnetized face 502*a* of the flywheel 502. The flywheel 502 affords an increased moment of inertia to thereby reduce unevenness of rotation of the drum 101.

When the photosensitive drum 101 coupled to the third embodiment is to be replaced, two screws 119 are removed, and a bearing block 114 is removed from the drive shaft 112. The drum 101 is thereafter removed from the drive shaft 112 merely by withdrawing the drum 101 in the direction of arrow shown in FIG. 6. This separates the drum 101 from the flywheel 502. Since the photosensitive drum 101 is thus separated from the flywheel 502, the drum 101 as removed is lightweight and easy to handle. Further with the third embodiment, the joint between the flange 504 and the flywheel 502 is provided by the magnetized faces 504*a* and 502*a*, so that backlash of the drum 101 attached to the flywheel 502 can be suppressed.

Next, a description will be given of a drum driving apparatus as a fourth embodiment of the present invention.

Figure 7:
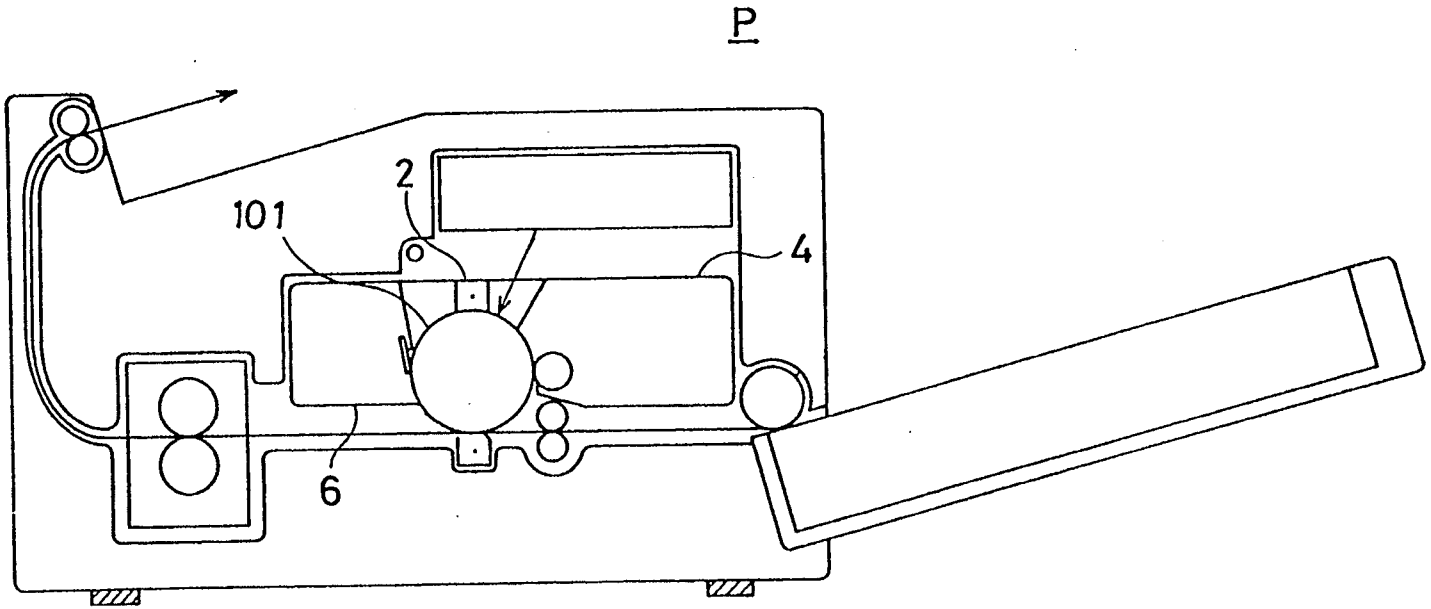
FIG. 7 is a diagram schematically showing the construction of a printer incorporating a drum driving apparatus as a fourth embodiment.
Figure 8:
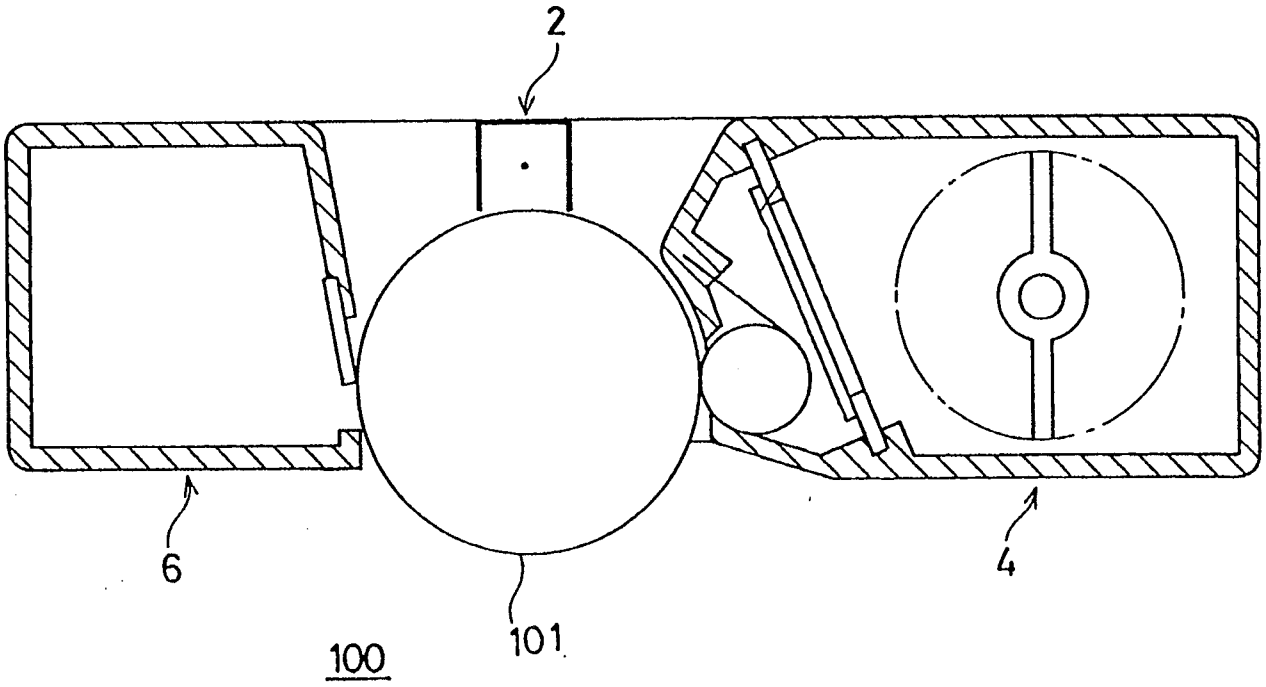
FIG. 8 is a diagram for schematically illustrating the construction of a process unit for use with the fourth embodiment.

The drum driving apparatus is usable also for driving a photosensitive drum within a process unit 100 shown in FIGS. 7 and 8. The process unit 100 comprises an assembly of photosensitive drum 101, sensitizing charger 2, developing device 4 and cleaner 6.

With the process unit 100 installed in a printer body P, a flywheel is provided inside the drum 101. When the process unit 100 is removed from the printer body P, the drum 101 incorporated in the process unit 100 is withdrawn, while the flywheel is adapted to remain in the printer body P. Thus, the process unit 100 is made replaceable with an improved work efficiency.

Figure 9:
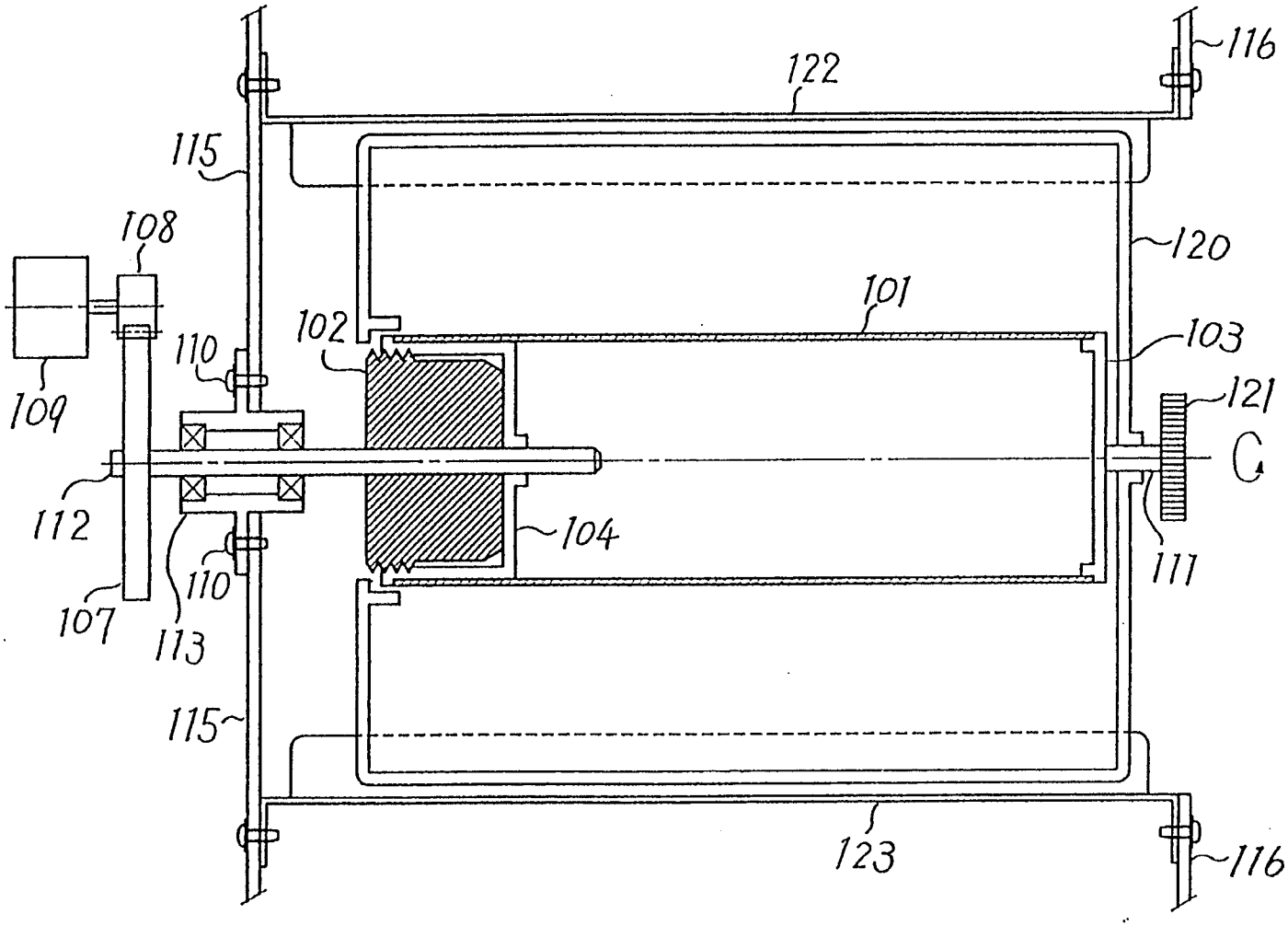
FIG. 9 is a diagram showing the construction of the drum driving apparatus of the fourth embodiment.
Figure 10:
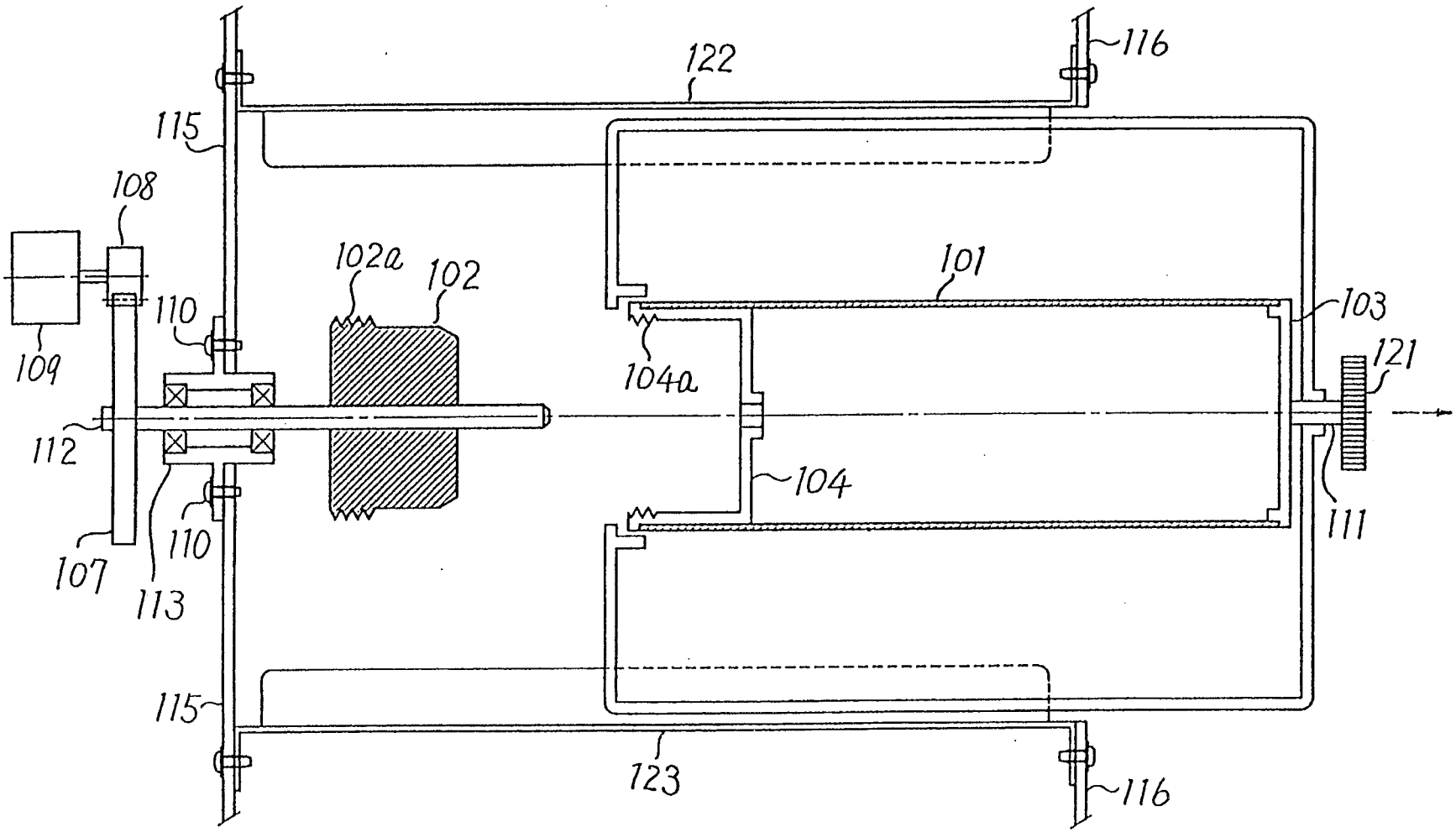
FIG. 10 is a diagram for illustrating a drum as removed from the fourth embodiment.

FIGS. 9 and 10 show the construction of the drum driving apparatus of the fourth embodiment in greater detail. With this apparatus, the photosensitive drum 101 is connected to the flywheel 102 by the same means as in the first embodiment. The unit 100 has a casing 120. A main frame 116 has an opening for withdrawing the casing 120 to the outside therethrough. Arranged between a main frame 115 and the main frame 116 are L-shaped guide members 122 and 123 extending longitudinally of the drum 101 for guiding the casing 120 therealong. A drive shaft 112 extends through a flange 104 to an intermediate portion of the length of the drum 101. Attached to a flange 103 is a shaft 111 having a knob 121 for manually rotating the drum 101.

In the construction described above, the casing 120 of the unit is installed into the printer body P along the guide members 122 and 123. The photosensitive drum 101 is attached to the drive shaft 112 by turning the knob 121 in such a direction that the internally threaded portion 104*a* of the flange 104 and the externally threaded portion 102*a* of the flywheel 102 are tightened up.

When the unit 100 is to be replaced, the knob 121 is rotated in a direction to unscrew the internally threaded portion 104*a* of the flange 104 from the externally threaded portion 102*a* of the flywheel 102, and the casing 120 is withdrawn along the guide members 122 and 123.

In this way, the photosensitive drum 101 is made into a unit inside the casing 120 and thereby prevented from defacement.

The photosensitive drum may be connected to the flywheel in the same manner as in the second or third embodiment.

Although the embodiments described above are adapted for use with the photosensitive drum, the present apparatus is also usable, for example, for a dielectric drum having no photosensitivity.

According to the first to third embodiments described, the drive shaft 112 extends through the photosensitive drum 101 but may alternatively comprise two shafts attached to the respective longitudinal ends of the drum 101. In this case, one of the two shafts is a drive shaft carrying the flywheel and supported by the bearing block 113. The other shaft is fixed to the drum 101 and supported by the bearing assembly 114. The drum 101 is removable when the bearing block 114 is removed.

Although the photosensitive drum is mounted on the drive shaft by the flywheel according to the foregoing embodiments, the flange may be mounted directly on the drive shaft. Further alternatively, the drum may be attached to the drive shaft by a member separate from the flywheel. In these cases, however, the flywheel is inserted in the photosensitive drum.

Although the present invention has been fully described by way of examples with reference to the accompanying drawings, it is to be noted that various changes and modifications will be apparent to those skilled in the art. Therefore unless otherwise such changes and modifications depart from the scope of the present invention, they should be construed as being included therein.

What is claimed is:

1. An apparatus comprising:

a hollow drum detachably provided on the apparatus;

drive means fixedly provided on the apparatus for drivingly rotating said drum, said drive means including a flywheel for giving an increased moment of inertia to said drum, wherein a part of said flywheel is positioned within said drum when said drum is attached to the apparatus.

2. The apparatus as claimed in claim 1, wherein said drum includes a photosensitive surface.

3. The apparatus as claimed in claim 1, wherein said drum is directly attached to said flywheel.

4. An apparatus comprising:

a hollow drum detachably provided on the apparatus, said drum including a flange having an open end;

drive means fixedly provided on the apparatus for drivingly rotating said drum, said drive means including a flywheel for giving an increased moment of inertia to said drum, wherein a part off said flywheel is inserted into said open end of the flange when said drum is attached to the apparatus.

5. The apparatus as claimed in claim 4, wherein said drum includes a photosensitive surface.

6. The apparatus as claimed in claim 4, wherein said flange has an internally threaded portion, and said flywheel has an externally threaded portion screwed in said internally threaded portion of said flange.

7. The apparatus as claimed in claim 4, wherein said flange has a sawtoothed joint portion along the circumference of said drum, and said flywheel has a sawtoothed joint portion meshable with said sawtoothed joint portion of said flange.

8. The apparatus as claimed in claim 4, wherein said flange has a magnetized face, and said flywheel has a magnetized face adapted to said magnetized face of said flange.

9. An apparatus comprising:

a process unit which is detachably provided on the apparatus and includes a photosensitive drum and a developing device for developing an image formed on said photosensitive drum, said photosensitive drum being hollow and including a flange having art open end;

drive means fixedly provided on the apparatus for drivingly rotating said drum, said drive means including a flywheel for giving an increased moment of inertia to said drum, wherein a part of said flywheel is inserted into said open end of the flange when said process unit is attached to the apparatus.

10. The apparatus as claimed in claim 9, wherein said process unit including a sensitizing charger for sensitized said photosensitive drum.

11. The apparatus as claimed in claim 9, wherein said process unit including a cleaner for cleaning said photosensitive drum.

* * * * *

UNITED STATES PATENT AND TRADEMARK OFFICE

CERTIFICATE OF CORRECTION

PATENT NO. : 5,371,576
DATED : December 6, 1994
INVENTOR(S) : Takashi Gonda

It is certified that error appears in the above-indentified patent and that said Letters Patent is hereby corrected as shown below:

In col. 5, line 25 (claim 4, line 7), change "off" to --of--.

In col. 6, line 18 (claim 9, line 7), change "art" to --an--.

Signed and Sealed this
Second Day of May, 1995

Bruce Lehman

*Attest:*

BRUCE LEHMAN

*Attesting Officer*

*Commissioner of Patents and Trademarks*